US009294833B2

(12) United States Patent
Oouchi et al.

(10) Patent No.: US 9,294,833 B2
(45) Date of Patent: Mar. 22, 2016

(54) SOUND COLLECTION DEVICE

(75) Inventors: Ryo Oouchi, Hamamatsu (JP); Yuichiro Suenaga, Hamamatsu (JP); Satoshi Ukai, Hamamatsu (JP); Seiichiro Hosoe, Hamamatsu (JP)

(73) Assignee: YAMAHA CORPORATION, Hamamatsu-Shi, Shizuoka (JP)

( * ) Notice: Subject to any disclaimer, the term of this patent is extended or adjusted under 35 U.S.C. 154(b) by 226 days.

(21) Appl. No.: 13/139,850

(22) PCT Filed: Dec. 16, 2009

(86) PCT No.: PCT/JP2009/070994
§ 371 (c)(1),
(2), (4) Date: Jun. 15, 2011

(87) PCT Pub. No.: WO2010/071157
PCT Pub. Date: Jun. 24, 2010

(65) Prior Publication Data

US 2012/0014535 A1 Jan. 19, 2012

(30) Foreign Application Priority Data

Dec. 17, 2008 (JP) ..... 2008-321345

(51) Int. Cl.
*H04R 1/40* (2006.01)
*H04R 3/00* (2006.01)

(52) U.S. Cl.
CPC ..... *H04R 1/406* (2013.01); *H04R 3/005* (2013.01)

(58) Field of Classification Search
CPC ..... H04R 3/005; H04R 1/406
USPC ..... 381/92, 356, 387, 355
See application file for complete search history.

(56) References Cited

U.S. PATENT DOCUMENTS 4,042,779 A 8/1977 Craven et al.
4,696,043 A * 9/1987 Iwahara et al. ..... 381/92
(Continued)

FOREIGN PATENT DOCUMENTS

EP 1 965 603 A1 9/2008
JP 51-32319 3/1976
(Continued)

OTHER PUBLICATIONS

JP Office Action issued Sep. 11, 2012 for corresponding JP2008-321345 (English Translation provided).
International Search Report issued in related PCT/JP2009/070994 mailed Jan. 26, 2010.
EESR issued Apr. 29, 2013 for corresponding EP 09833460.
Chinese Office Action cited in Chinese counterpart application No. CN200980148146.8, dated Jan. 26, 2015. English translation provided.

*Primary Examiner* — Disler Paul
(74) *Attorney, Agent, or Firm* — Rossi, Kimms & McDowell LLP

(57) ABSTRACT

The invention provides a sound collection device having little error in a desired directivity. The sound collection device includes a unidirectional microphone 12A, a unidirectional microphone 12B, and a unidirectional microphone 12C which are arranged on one plane. Each of the unidirectional microphones has the maximum sensitivity direction directed toward the inside of the arrangement. Each of the unidirectional microphones has a rear surface (direction of the minimum sensitivity) being open acoustically. Since the maximum sensitivity direction of each of the unidirectional microphones is directed toward the inside of the arrangement, the oscillation plane of each of the unidirectional microphones can be positioned substantially at the center of the arrangement. Thus, by adjusting the gain of the sound collected by the respective unidirectional microphones, the directivity can be freely formed on a flat plane with little error.

7 Claims, 6 Drawing Sheets

(56) References Cited

U.S. PATENT DOCUMENTS

| | | | | |
|---|---|---|---|---|
| 5,260,920 | A | 11/1993 | Ide et al. | |
| 5,862,240 | A * | 1/1999 | Ohkubo et al. | 381/356 |
| 7,058,184 | B1 * | 6/2006 | Hickling | 381/92 |
| 7,149,315 | B2 | 12/2006 | Johnston et al. | |
| 7,672,196 | B1 | 3/2010 | Hanyu | |
| 8,243,951 | B2 * | 8/2012 | Ishibashi et al. | 381/92 |
| 2002/0064287 | A1 * | 5/2002 | Kawamura et al. | 381/92 |
| 2004/0252849 | A1 | 12/2004 | Johnston et al. | |
| 2008/0044033 | A1 | 2/2008 | Ozawa | |
| 2009/0268925 | A1 * | 10/2009 | Reining | 381/92 |
| 2010/0166212 | A1 * | 7/2010 | Ishibashi et al. | 381/92 |
| 2011/0058683 | A1 * | 3/2011 | Kosteva et al. | 381/92 |
| 2012/0281854 | A1 | 11/2012 | Ishibashi et al. | |

FOREIGN PATENT DOCUMENTS

| | | | |
|---|---|---|---|
| JP | 5-191882 | A | 7/1993 |
| JP | 2001-153941 | A | 6/2001 |
| JP | 2008-48355 | A | 2/2008 |
| JP | 2008-177802 | A | 7/2008 |
| WO | 2006/006935 | A1 | 1/2006 |
| WO | 2006-054599 | A1 | 5/2006 |

* cited by examiner (A)

(B)

(A)

(B)

SOUND COLLECTION DEVICE

This application is a U. S. National Phase Application of PCT International Application PCT/JP2009/070994 filed on Dec. 16, 2009 which is based on and claims priority from JP 2008-321345 filed on Dec. 17, 2008 the contents of which are incorporated herein by reference in their entirety.

TECHNICAL FIELD

The present invention relates to a sound collection device which collects sound around a housing.

BACKGROUND ART

Hitherto, a device described in Patent Literature 1 is provided, for example, as a device for collecting sound around a housing. The device in Patent Literature 1 includes microphones on respective surfaces of a tetrahedron, so that the device can collect sounds in all directions.

There is also proposed a device in which sound-collection directions of three unidirectional microphones are displaced 120 degrees apart outwardly and the sound in all directions are collected so as to detect the direction of the sound source on the basis of a sound-collection level of each unidirectional microphone (see Patent Literature 2, for instance).

A device for collecting sound in an arbitrary direction using a plurality of microphones is also proposed (see Patent Literature 3, for instance).

CITATION LIST

Patent Literature

Patent Literature 1: JP-A-51-32319

Patent Literature 2: JP-A-2001-153941

Patent Literature 3: JP-A-2008-48355

SUMMARY OF INVENTION

Technical Problem

In the devices in Patent Literatures 1 to 3, since the vibration planes of the microphones are away from one another, it causes large error with respect to a desired directivity, especially in high frequency bands such as 1 kHz or more frequency bands.

An object of the invention is, therefore, to provide a sound collection device having little error in a desired directivity.

Solution to Problem

A sound collection device according to the invention is a sound collection device, including: a plurality of unidirectional microphones; a plurality of gain adjustment units which are configured to adjust gains of sounds collected by the respective microphones; and an adder which is configured to add the gain-adjusted sounds to one another, wherein the plurality of unidirectional microphones are arranged on one plane, and the maximum sensitivity direction of each of the unidirectional microphones is directed toward the inside of the arrangement.

In this way, since each microphone has the maximum sensitivity direction directed toward the inside of the arrangement, it is possible to closely arrange the vibration planes as compared with directing them outwardly. Accordingly, when the signals are added to one another by the adder, the time lag of the signals obtained at the vibration planes of the different microphones is suppressed, and it is possible to suppress the error with respect to the desired directivity.

Thus, according to the sound collection device of the invention, it is possible to suppress the error with respect to the desired directivity even in high frequency bands such as 1 kHz or more frequency bands Another unidirectional microphone may be further provided at a position which differs from the one plane, the maximum sensitivity direction of the other unidirectional microphone being directed toward a direction opposite to a direction of the one plane.

Another unidirectional microphone may be further at a position which differs from the one plane, the maximum sensitivity direction of the other unidirectional microphone being directed toward a direction of the one plane.

In this case, the directivity can be formed in a direction in which another unidirectional microphone is arranged in addition to on the one plane. Thus, the directivity can be freely formed in three dimensional directions.

The plurality of unidirectional microphones may be arranged to constitute a polygon having vertices of the respective unidirectional microphones, and the maximum sensitivity direction of each of the unidirectional microphones may be directed toward a line of the polygon or inside the polygon.

The plurality of unidirectional microphones may be arranged so that sensitivity axes of the unidirectional microphones intersect at one point.

The plurality of unidirectional microphones may be arranged on a circle around the one point as a center of the circle.

The plurality of unidirectional microphones may be arranged on a circle.

The plurality of unidirectional microphones may be arranged on the circle at regular intervals.

Advantageous Effects of Invention

According to the invention, it is possible to closely arrange the vibration planes of the plurality of directional microphones, thereby having little error in a desired directivity.

DESCRIPTION OF EMBODIMENTS

Figure 1:
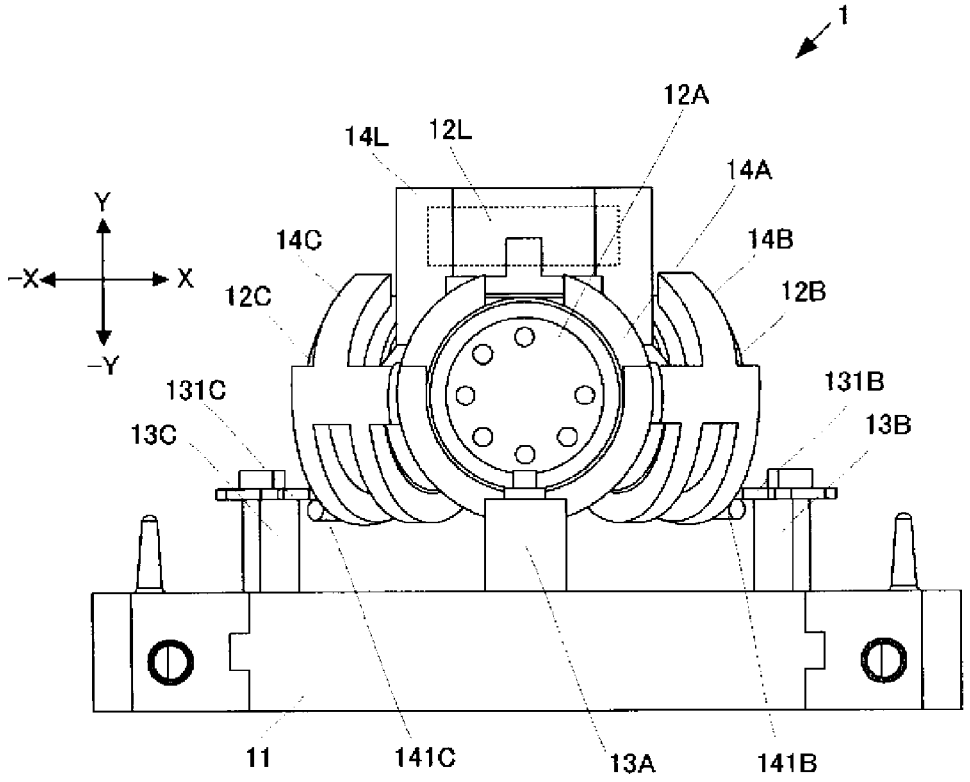
FIG. 1 is a front view of a sound collection device.
Figure 2:
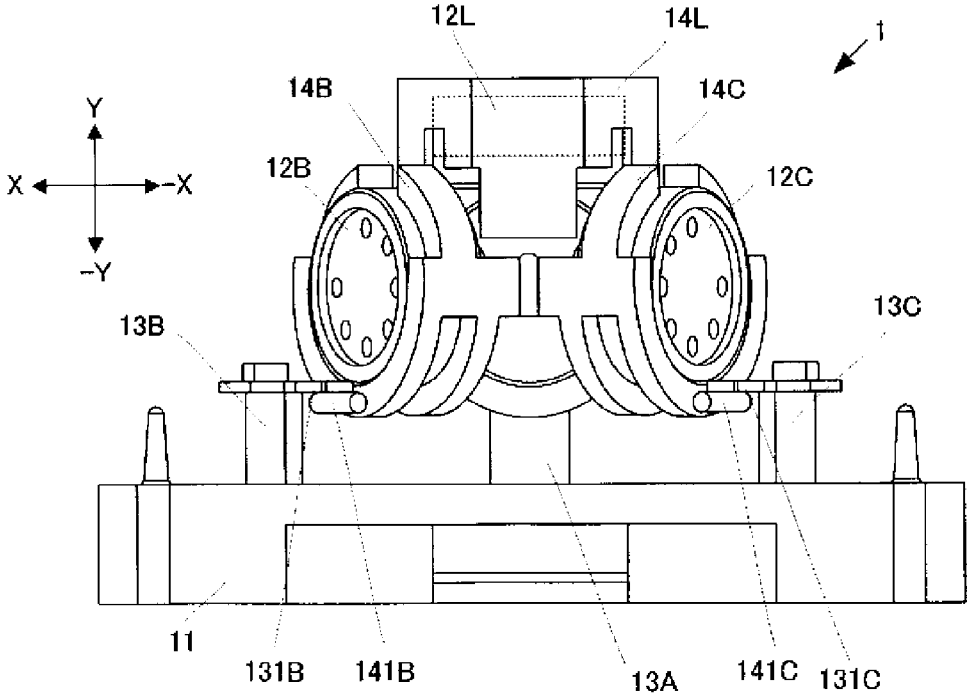
FIG. 2 is a rear view of the sound collection device.
Figure 3:
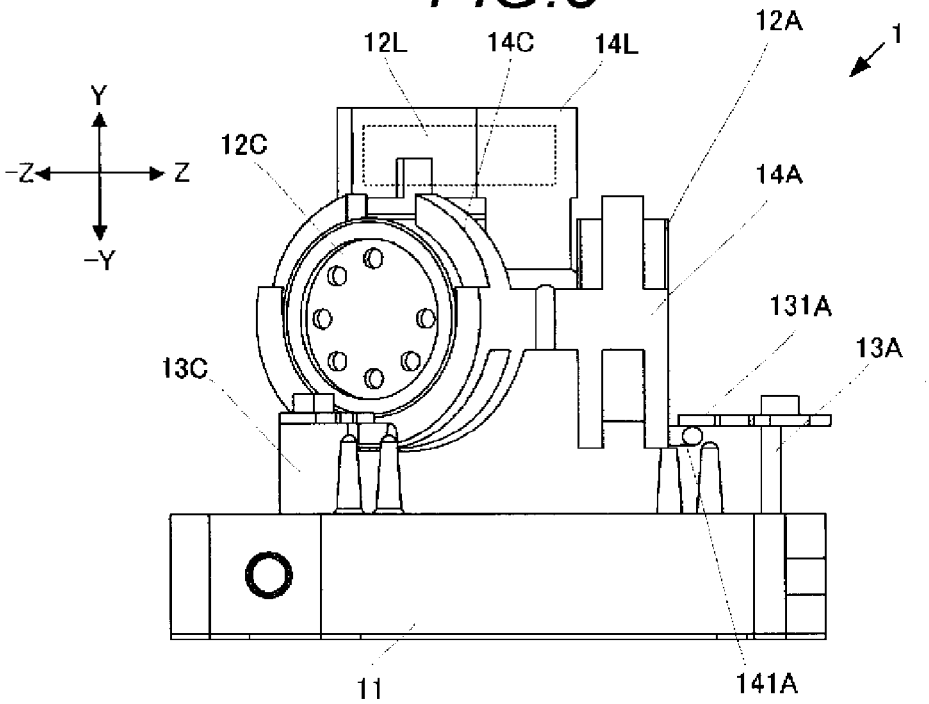
FIG. 3 is a left side view of the sound collection device.
Figure 4:
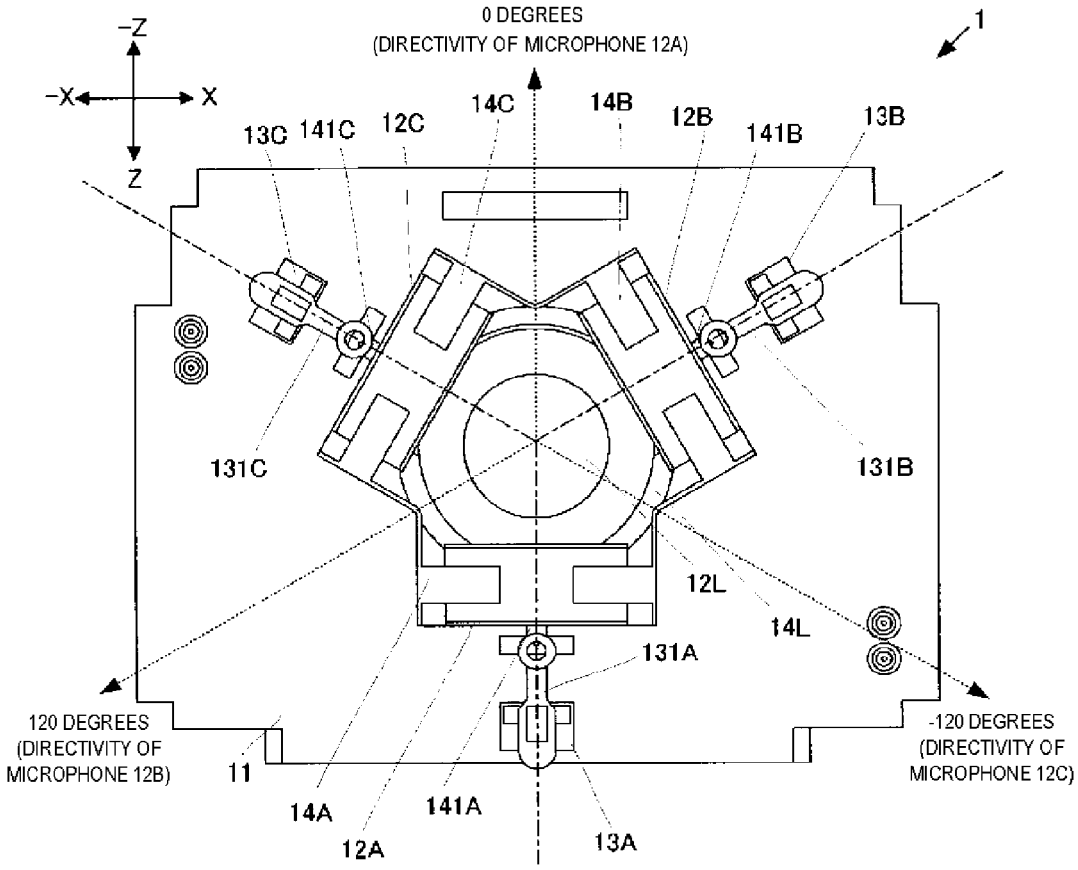
FIG. 4 is a plan view of the sound collection device.

FIGS. 1 to 4 are outer appearance views showing the configuration of a sound collection device according to an embodiment. FIG. 1 is a front view, FIG. 2 is a rear view, FIG. 3 is a left side view, and FIG. 4 is a plan view. In FIGS. 1 to 4, the right side of the sound collection device indicates "X", the left side indicates "−X", the upper side indicates "Y", the lower side indicates "−Y", the front side indicates "Z", and the rear side indicates "−Z".

A housing 11 as a base of a sound collection device 1 has a cubic shape which is vertically thin, and made of a resin material, for example. Three supports 13A, 13B, 13C are vertically mounted on upper surface of the housing 11. Each of the supports is also made of a resin material, for example.

The support 13A is mounted at a front side of the device, the support 13B is mounted at a right rear side of the device, and the support 13C is mounted at a left rear side of the device. As shown in the plan view of FIG. 4, each of the supports is arranged at an equal distance from a center position of the housing, and equally aligned at 120 degrees intervals.

Plate-like elastic rubbers 131A, 131B, 131C being vertically thinned are attached to tops of the respective supports 13A, 13B, 13C. The elastic rubbers 131A, 131B, 131C are extended toward a center of the housing, and attached to joints 141A, 141B, 141C provided in lower part of microphone frames 14A, 14B, 14C, respectively.

Each of the microphone frames 14A, 14B, 14C has a cylindrical shape. A columnar microphone (unidirectional microphone) can be fit inside the hollow of the frame. Cylinder-bottom openings of the respective microphone frames are directed toward directions at 120 degrees apart when the sound collection device is viewed in plan view.

That is, a cylinder-bottom opening of the microphone frame 14A is directed to a front side and a rear side of the device, and the unidirectional microphone can be disposed so that its directivity is directed in the front side and the rear side of the device. As shown in FIG. 4, in this embodiment, a direction of maximizing sensitivity (the maximum sensitivity direction) of the unidirectional microphone 12A fitted into the microphone frame 14A is directed toward the rear side of the device. The maximum sensitivity direction of the unidirectional microphone 12A is defined as 0 degrees.

A cylinder-bottom opening of the microphone frame 14B is directed to a right rear side and a left front side of the device. In this embodiment, the maximum sensitivity direction of the unidirectional microphone 12B fitted into the microphone frame 14B is directed toward the left front side of the device. That is, the maximum sensitivity direction is directed to an angle by rotating 120 degrees (+120 degrees direction) to the left from 0 degrees when the housing is viewed in plan view.

A cylinder-bottom opening of the microphone frame 14C is directed to a left rear side and a right front side of the device. In this embodiment, the maximum sensitivity direction of the unidirectional microphone 12C fitted into the microphone frame 14C is directed toward the right front side of the device. That is, the maximum sensitivity direction is directed to an angle by rotating 120 degrees (−120 degrees direction or +240 degrees direction) to the right from 0 degrees when the housing is viewed in plan view.

Further, a similar microphone frame 14L having a cylindrical shape is provided at a center side of the housings of the microphone frames in a state where the sound collection device 1 is viewed in plan view. As shown in FIGS. 1 to 3, the microphone frame 14L is provided above the microphone frames 14A to 14C, and its cylinder-bottom opening is directed to an upper side and a lower side of the device. In this embodiment, the maximum sensitivity direction of the unidirectional microphone 12L fitted into the microphone frame 14L is directed toward the upper side of the device.

The microphone frames 14A, 14B, 14C, 14L are made by integral molding of a resin mold, and can fix the four microphones fitted into the respective frames as one unit.

The integral-molded frames are formed so that directional axes (axes of the maximum sensitivity directions) of the unidirectional microphones 12A, 12B, 12C intersect at one point when the sound collection device is viewed in plan view. In the sound collection device according to the embodiment, the center position of the housing of the sound collection device 1 coincides with the intersection point of the directional axes by adjusting the shape and the placement position of the three supports, the elastic rubbers and the joints.

By adopting the structure, the unidirectional microphones 12A, 12B, 12C are arranged on one plane (a plane in parallel to the upper surface of the housing), so each of the unidirectional microphones has the maximum sensitivity direction directed toward the inside of the arrangement. That is, the unidirectional microphones are aligned inwardly on a circle around the intersection point of the directional axes as a center of the circle. In this way, since each microphone has the maximum sensitivity direction directed toward the inside of the arrangement, it is possible to closely arrange the vibration planes as compared with directing them outwardly. As a result, the position of the vibration plane of each of the unidirectional microphones is approximated by the intersection point of the directional axes. Thus, the directivity control in the plane can be realized with little error even in high frequency bands such as 1 kHz or more frequency bands.

The four microphones are fixed by the supports, the elastic rubbers, and the joints in a state where the microphones float in the hollow away from the upper surface of the housing 11. In particular, the vertically-unidirectional microphone 12L is disposed above the plane formed by the unidirectional microphone 12A, the unidirectional microphone 12B and the unidirectional microphone 12C, and disposed at a furthest position from the upper surface of the housing 11. Thus, the rear side of the unidirectional microphone 12L is also open acoustically.

Figure 5:
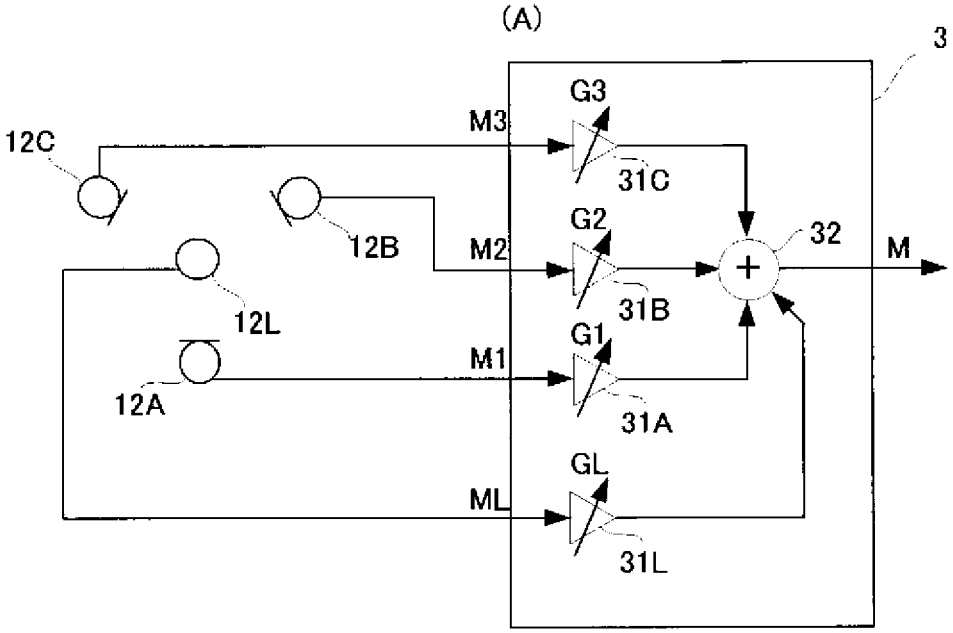
FIG. 5 is a block diagram showing the configuration of a sound signal processing system of the sound collection device.
Figure 5:
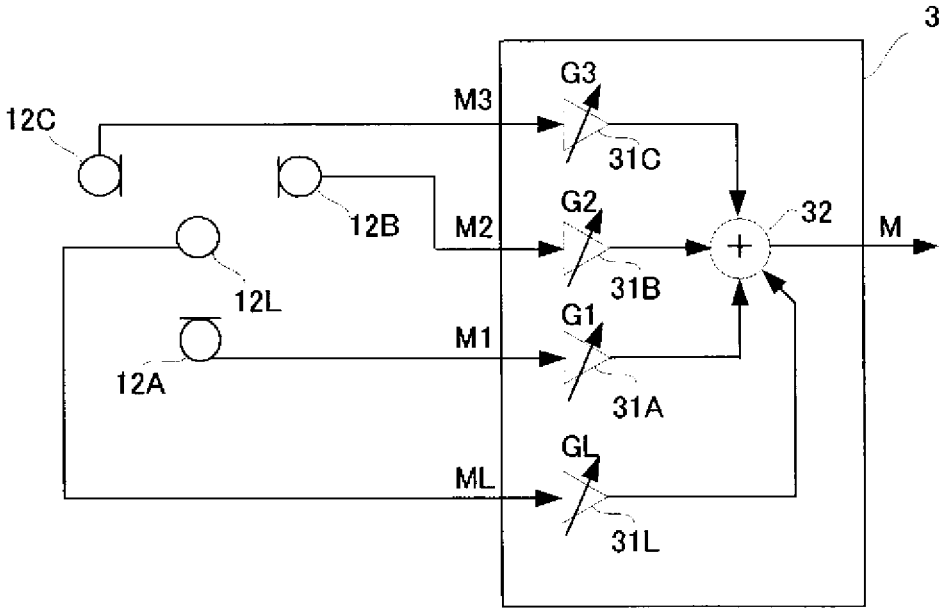
Figure 6:
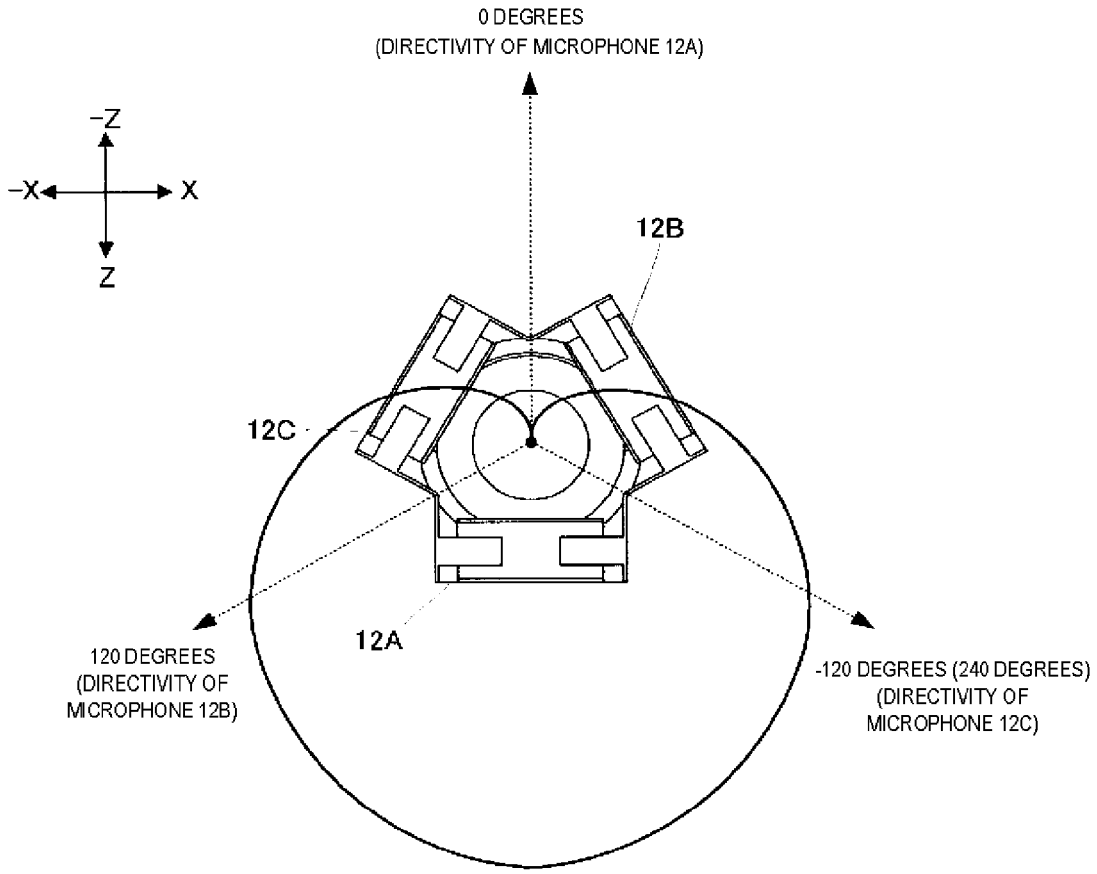
FIG. 6 is a schematic diagram showing a form of a directivity control.
Figure 6:
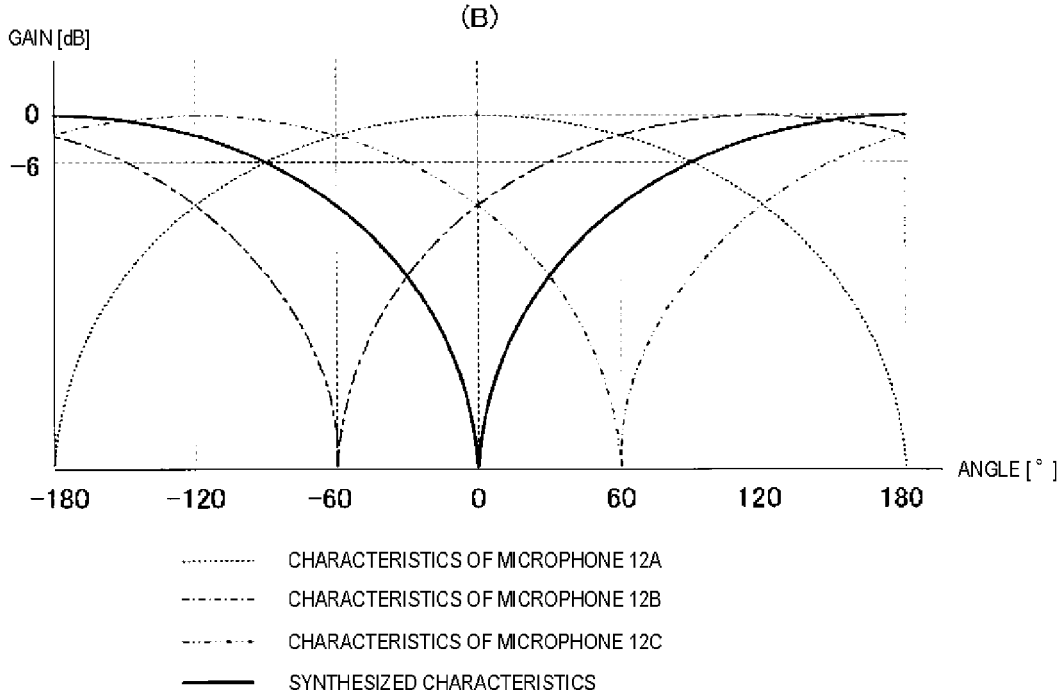

Next, directivity control of the sound collection device 1 is described. In FIG. 5, (A) is a block diagram showing the configuration of a sound signal processing system in the sound collection device. FIG. 6 is a schematic diagram showing a form of the directivity control. The characteristics shown in FIG. 6 are ideal characteristics for explanation, but are not a graph showing the actual characteristics.

The sound collection device 1 includes, as a configuration of the signal processing system, a signal processing unit 3 including gain adjustment units 31A, 31B, 31C, 31L and an adder 32.

Sound signals output by the respective unidirectional microphones are adjusted in gain in the respective gain adjustment units of the signal processing unit 3, and then added to one another in the adder 32. The sound collection device 1 can form an arbitrary directivity around the device by controlling the gain of each gain adjustment unit.

Each gain (G1, G2, G3) of the respective gain adjustment units 31A, 31B, 31C is determined, where the direction for forming the directivity (angle to the maximum sensitivity direction) is θ, and weighting factor of the microphone is f, as follows:

$$G1=\tfrac{2}{3}\times\{1-f(1-2\cos\theta)\}$$

$$G2=\tfrac{2}{3}\times\{1-f(1-2\cos(\theta-120°))\}$$

$$G3=\tfrac{2}{3}\times\{1-f(1-2\cos(\theta+120°))\}$$

The weighting factor f indicates a factor for determining a shape of the directivity, and runs from 0 through 1. For example, it is determined as non-directivity when f=0, unidirectivity when f=0.5, and bi-directivity when f=1. Here, the directivity can be formed in an arbitrary direction by determining a value of θ arbitrarily. For example, as shown by (A) in FIG. 6, in a case where θ=180 degrees, i.e., the uni-directivity is formed in the front side (Z direction) of the device, when the weighting factor f=0.5, the value of each gain is determined as follows:

$$(G1,G2,G3)=(-1/3,2/3,2/3).$$

A signal M to be output is expressed, using output signals M1, M2, M3 of the unidirectional microphones 12A, 12B, 12C, as follows:

$$M=G1\times M1+G2\times M2+G3\times M3=-1/3\times M1+2/3\times M2+2/3\times M3.$$

In this way, as shown by (B) in FIG. 6, the angle of the maximum sensitivity direction of the synthesized characteristics of the three microphones can be directed to 180 degrees, and its minimum sensitivity direction be directed to 0 degrees. That is, it is possible to form a uni-directivity in a direction of θ=180 degrees Since each of the unidirectional microphones has the maximum sensitivity direction directed toward the inside of the arrangement as mentioned above, the sound collection device according to the embodiment can approximate the position of the vibration plane of each of the unidirectional microphones by the intersection point of the directional axes. Further, by adopting the calculating formulas as mentioned above, the sound collection device can suppress error with respect to the desired directivity sufficiently even in high frequency bands such as 1 kHz or more frequency bands.

Figure 7:
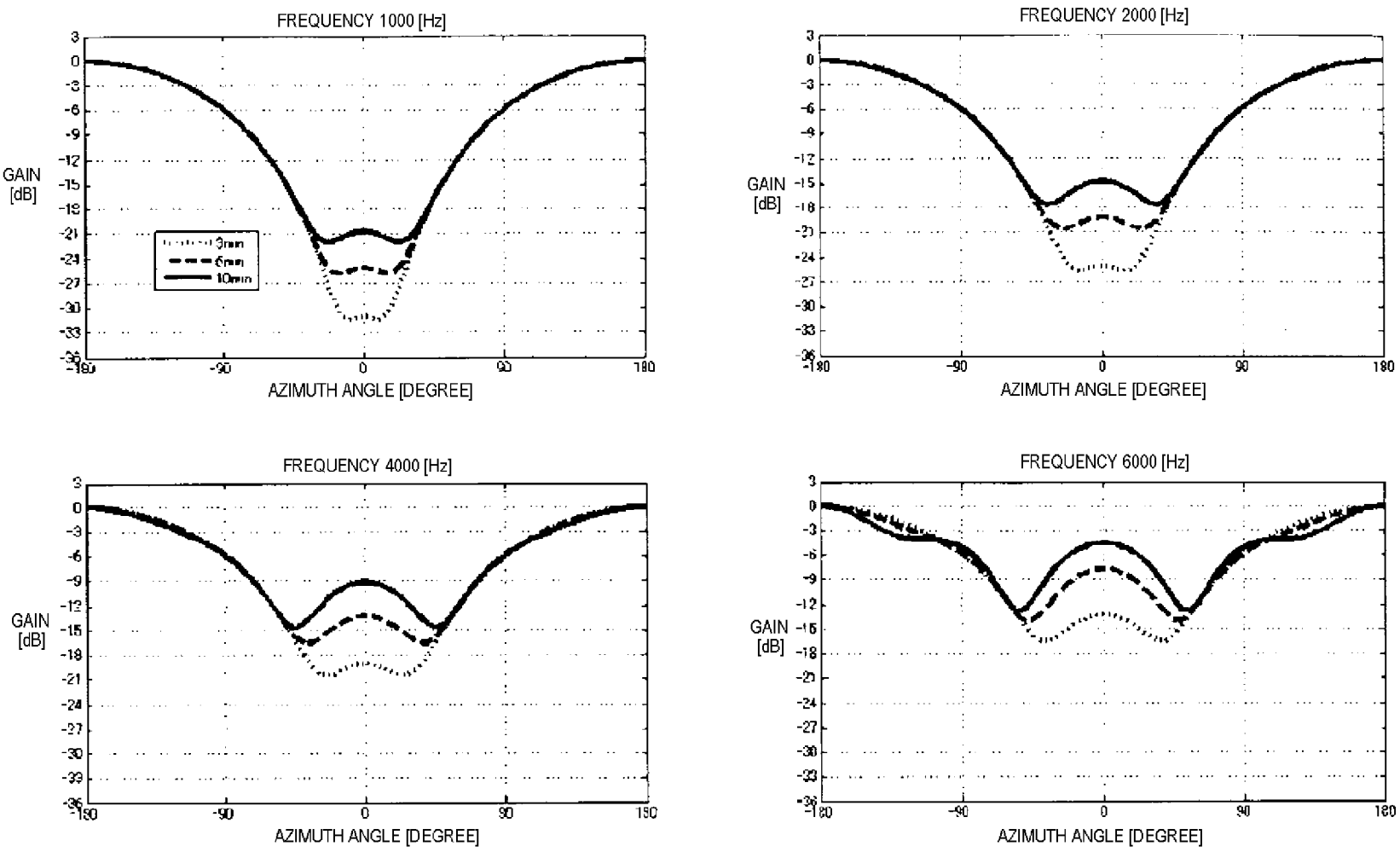
FIG. 7 shows directivity characteristics obtained when the distance of the sound collection plane of microphone from a center position is varied.

FIG. 7 shows directional characteristics (gains for each angle) obtained when the distance of the sound collection plane of microphone from the center position is varied. FIG. 4 shows directional characteristics in 1 kHz, 2 kHz, 4 kHz and 8 kHz obtained when the distance of the sound collection plane of microphone from the center position is varied at 3 mm, 6 mm, and 10 mm.

As shown in FIG. 7, the smaller the distance from the center position to the vibration plane of the microphone is, the smaller the minimum value of the sensitivity in the vicinity of 0 degrees is even in the high frequency. That is, the characteristics as uni-directivity can be obtained up to the high frequency.

For example, when the thickness of the each of the unidirectional microphone is about 3 mm, the distance from the center position to the vibration plane of the microphone differs by about 3 mm between cases where the maximum sensitivity direction of each microphone is directed toward the outside of the arrangement and toward the inside of the arrangement. That is, the difference to the extent between characteristics in 3 mm and characteristics in 6 mm occurs (the difference of about 6 dB occurs in the minimum value of the sensitivity).

Accordingly, it is said that directing the maximum sensitivity direction of each unidirectional microphone toward the inside of the arrangement is effective to achieve the formation of the directivity even in high frequency bands such as 1 kHz or more frequency bands (the position of the vibration plane of each microphone can be approximated by the center position).

Figure 8:
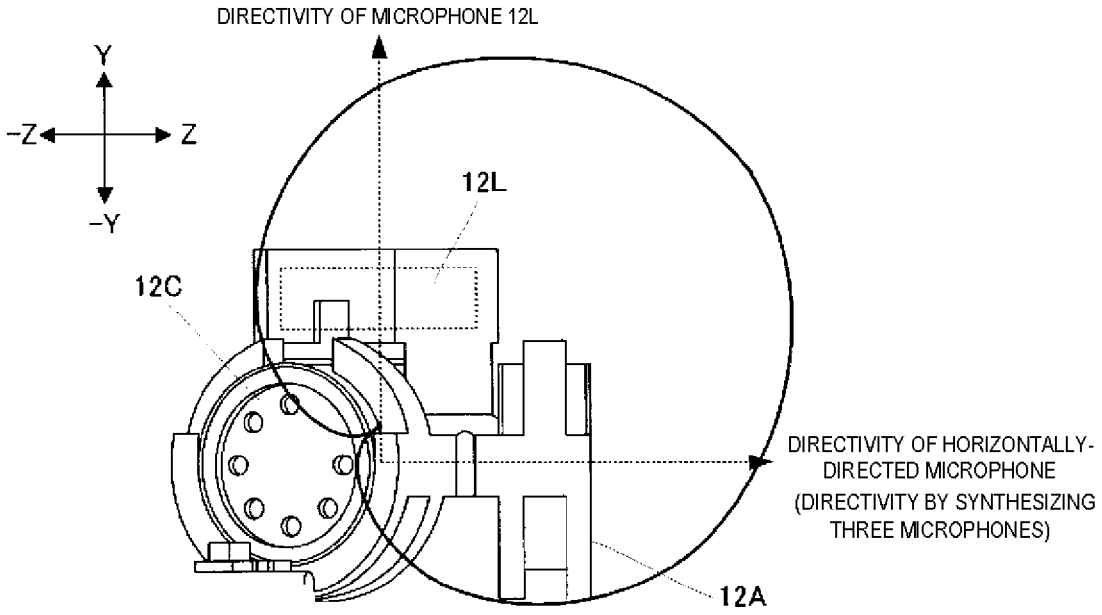
FIG. 8 is a schematic diagram showing a form of a directivity control in an upper direction.

In the sound collection device according to this embodiment, by using the vertically-unidirectional microphone 12L, it is possible to form the directivity in arbitrary direction with respect to the upper side of the device, in addition to on the one plane in which the unidirectional microphones 12A, 12B, 12C are arranged. For example, as shown in FIG. 8, when the gain adjustment is performed so that the gain with respect to the sound signal collected by horizontal microphones (combination of the unidirectional microphones 12A, 12B, 12C) by which the uni-directivity is formed in a direction of θ=180 degrees becomes the same as the gain with respect to the sound signal collected by the vertically-unidirectional microphone 12L, the directional axis can be formed in a front upper side (Y, Z direction) of the device.

Since the unidirectional microphones 12A, 12B, 12C have actually their sensitivities in a lower side of the housing, the sound collection device according to the embodiment can form the directivity freely in three dimensional directions.

The arrangement of each of the unidirectional microphones is not limited to the example as mentioned above. For example, the arrangement as shown by (B) in FIG. 5 can be adopted.

In FIG. 5, (B) indicates an arrangement example in which the unidirectional microphone 12B is opposite to the unidirectional microphone 12C. In this case, the maximum sensitivity direction of the unidirectional microphone 12B corresponds to a left side (a direction of θ=90 degrees) of the device, and the maximum sensitivity direction of the unidirectional microphone 12C corresponds to a right side (a direction of θ=−90 degrees) of the device. Even in a case where the unidirectional microphone 12B is opposite to the unidirectional microphone 12C in this way, the directivity can be formed in arbitrary direction. In the example shown by (B) in FIG. 5, each gain (G1, G2, G3) of the respective gain adjustment units 31A, 31B, 31C is determined as follows:

$$G1=2f\cos\theta$$

$$G2=1-f\{1+\sqrt{2}\cos(\theta+45°)\}$$

$$G3=1-f\{1+\sqrt{2}\cos(\theta-45°)\} \quad \text{[Expression 1]}$$

In this case, in a case where θ=180 degrees, i.e., the uni-directivity is formed in the front side of the device, when the weighting factor f=0.5, the value of each gain is determined as follows:

$$(G1,G2,G3)=(-1,1,1).$$

In this way, only if a form in which three or more unidirectional microphones are arranged on one plane and the maximum sensitivity direction of each of the unidirectional microphones is directed toward the inside of the arrangement is adopted, the sound collection device of the invention can be achieved by any arrangement forms. In other words, when a polygon (a triangle) having vertices of the unidirectional microphones 12A, 12B, 12C is assumed, it is only necessary to adopt an arrangement in which the maximum sensitivity direction of each of the unidirectional microphones is directed to a line of the polygon or inside the polygon.

Although the above example describes an example in which the three microphones in the same plane, more microphones may be arranged on the same plane. Further, the vertically-unidirectional microphone is not limited to one, but more microphones may be provided. For example, there may be provided a microphone having a directivity in a direction (a direction toward the plane) opposite to that of the vertically-unidirectional microphone 12L. In this case, only the microphone having the directivity in the direction opposite to that of the unidirectional microphone 12L may be provided without providing the unidirectional microphone 12L.

Although, in the above example, as shown in FIG. 4, the unidirectional microphones are equally arranged on the circle around the intersection point of the directional axes of the unidirectional microphones 12A, 12B, 12C as a center of the circle, the invention is not limited thereto. That is, it is not essential to equally arrange the microphones on the circle only if each microphone has the maximum sensitivity direction directed toward the inside of the arrangement, and the vibration planes of the plurality of unidirectional microphones are closely disposed each other.

The invention claimed is:

1. A sound collection device comprising:

a single integrally-molded body having a plurality of interconnecting parts;

a plurality of unidirectional microphones each fitted on the single integrally-molded body;

a plurality of gain adjustment units configured to adjust gains of sounds collected by the respective plurality of unidirectional microphones; and an adder configured to add the gain-adjusted sounds to one another, wherein the plurality of unidirectional microphones are arranged on one plane on a circle, wherein each of the plurality of interconnecting parts is disposed between a pair of adjacent unidirectional microphones, among the plurality of unidirectional microphones, with no other unidirectional microphone disposed between the pair of adjacent unidirectional microphones, wherein each of the plurality of unidirectional microphones is disposed so that a maximum sensitivity direction thereof is directed toward one of the plurality of interconnecting parts and intersects a center of the circle.

2. The sound collection device according to claim 1, further comprising:

an auxiliary unidirectional microphone provided at another plane that differs from the one plane, wherein the maximum sensitivity direction of the auxiliary unidirectional microphone is directed away from the one plane.

3. The sound collection device according to claim 1, further comprising:

an auxiliary unidirectional microphone provided at another plane that differs from the one plane, wherein the maximum sensitivity direction of the auxiliary unidirectional microphone is directed toward the one plane.

4. The sound collection device according to claim 1, wherein:

the single integrally-molded body is configured as a polygon having vertices, and the maximum sensitivity direction of each of the unidirectional microphones is directed toward a line of the polygon or inside the polygon.

5. The sound collection device according to claim 4, wherein the circle intersects each of the vertices so that the center of the circle is also a center of the polygon.

6. The sound collection device according to claim 1, wherein the plurality of unidirectional microphones are arranged at regular intervals on the circle.

7. The sound collecting device according to claim 1, further comprising a housing on which the single integrally-molded unit is attached.

* * * * *